US006803883B2

(12) United States Patent
Abrams et al.

(10) Patent No.: US 6,803,883 B2
(45) Date of Patent: Oct. 12, 2004

(54) RADIO FREQUENCY ELECTROMAGNETIC EMISSIONS SHIELD

(75) Inventors: Ted A. Abrams, Cary, NC (US); John M. Duckworth, Holly Springs, NC (US); Gregory A. O'Neill, Jr., Cary, NC (US); Ludwik J. Wodka, Cary, NC (US); Arie C. Slaa, Austin, TX (US)

(73) Assignee: SpectraSite Communications, Inc., Cary, NC (US)

( * ) Notice: Subject to any disclaimer, the term of this patent is extended or adjusted under 35 U.S.C. 154(b) by 42 days.

(21) Appl. No.: 10/248,732

(22) Filed: Feb. 13, 2003

(65) Prior Publication Data

US 2004/0160378 A1 Aug. 19, 2004

(51) Int. Cl.[7] ..... H01Q 1/52

(52) U.S. Cl. ..... 343/841; 343/702; 343/779; 343/780

(58) Field of Search ..... 343/841, 702, 343/779, 780, 782, 784, 783; H01Q 1/52

(56) References Cited

U.S. PATENT DOCUMENTS

| | | | | |
|---|---|---|---|---|
| 2,464,006 | A | 3/1949 | Tiley | 343/18 |
| 2,870,439 | A | 1/1959 | Stinehelfer | 343/18 |
| 2,977,591 | A | 3/1961 | Tanner | 343/18 |
| 2,994,400 | A | 8/1961 | Heller | 181/33 |
| 3,806,943 | A | 4/1974 | Holloway | 343/703 |
| 3,836,967 | A | 9/1974 | Wright | 343/18 |
| 4,050,073 | A | 9/1977 | Wesch | 343/18 |
| 4,096,483 | A | 6/1978 | Bui Hai et al. | 343/781 |
| 4,164,718 | A | 8/1979 | Iwasaki | 333/81 |
| 4,948,922 | A | 8/1990 | Varadan et al. | 174/35 |
| 4,965,606 | A | 10/1990 | Merkel | 343/703 |
| 5,275,880 | A | 1/1994 | Boyer, III et al. | 428/328 |
| 5,298,903 | A | 3/1994 | Janos | 342/4 |
| 5,307,081 | A | 4/1994 | Harmuth | 343/842 |
| 5,338,896 | A | 8/1994 | Danforth | 174/35 |
| 5,373,304 | A | 12/1994 | Nolan et al. | 343/841 |
| 5,486,838 | A | 1/1996 | Dienes | 343/781 |
| 5,550,552 | A | 8/1996 | Oxley | 343/702 |
| 5,714,961 | A | 2/1998 | Kot et al. | 343/769 |
| 6,025,804 | A | 2/2000 | Davis et al. | 343/702 |
| 6,094,174 | A | 7/2000 | Knop et al. | 343/781 |
| 6,107,973 | A | 8/2000 | Knop et al. | 343/781 |
| 6,115,003 | A | 9/2000 | Kozakoff | 343/840 |
| 6,225,957 | B1 | 5/2001 | Yamaguchi | 343/755 |
| 6,249,256 | B1 * | 6/2001 | Luxon et al. | 343/702 |
| 6,615,026 | B1 * | 9/2003 | Wong | 455/575.5 |

* cited by examiner

*Primary Examiner*—Hoanganh Le
(74) *Attorney, Agent, or Firm*—Nelson Mullins Riley & Scarborough

(57) ABSTRACT

A shield for shielding radio frequency emissions being emitted from a communications antenna. The shield has a first layer of material having the physical property of generally absorbing radio frequency electromagnetic emissions and a second layer of material having the physical property of generally reflecting radio frequency emissions. The first layer of material is positioned between the second layer of material and the communications antenna. Therefore, the first layer of material absorbs a portion of the radio frequency emissions from the communications antenna, and the second layer of material reflects back the remaining emissions to the first layer of material. Therefore, the first layer absorbs a further portion of the remaining emissions. A layer of absorbing material is placed between the combined first & second layers and a material that is transparent to radio frequency emissions and through which the communications antenna radiates radio frequency energy. The purpose of the absorbing material between the transparent material and the combined first & second layers is to minimize escape of radio frequency energy along the transparent material. The radio frequency energy could otherwise escaped around the barrier of the first & second layers due to reflection and refraction of radio frequency energy within the body of the transparent material.

22 Claims, 8 Drawing Sheets

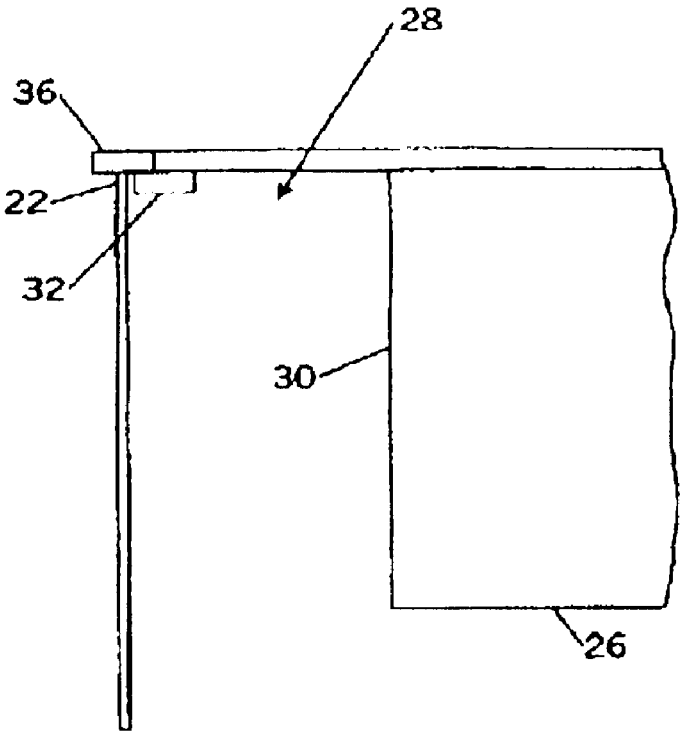
FIG. 2
FIG. 3
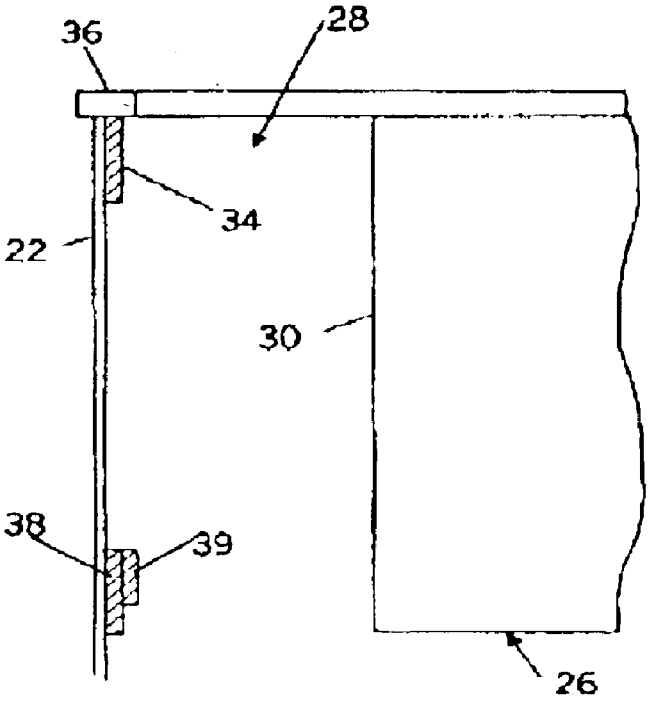

RADIO FREQUENCY ELECTROMAGNETIC EMISSIONS SHIELD

BACKGROUND OF INVENTION

FIELD OF THE INVENTION

The present invention relates to shielding of radiating radio frequency electromagnetic emissions and more particularly to shielding a source of such emissions so as to protect from excessive, prolonged exposure to such emissions any people and objects that might be injured or damaged by such exposure, while still facilitating the efficient and unobstructed emission from the source, for its intended purpose.

Shields for shielding people and objects from radio frequency electromagnetic emissions have long been known and have a number of uses. In recent years there has been a very significant increase in the use of mobile telephones and paging devices. As their use has increased, more communications towers have been built for radio frequency transmissions for communication devices, such as mobile telephones, pagers and the like. Also, it has become increasingly common for radio frequency communications of this type to be transmitted from antennae located on and in buildings and at other locations close to large numbers of people, both inside and outside of the building. The increased amount of transmission near concentrations of people has led to an increased need for a simple, economical, and compact shield to protect people and the environment from stray radio frequency emissions.

Accordingly, there is a need to provide a shield for electromagnetic radio frequency emissions, which is simple, economical, and compact, and which is an efficient means for protecting people and the environment from radio frequency emissions from communications antennae transmitting to mobile telephones and pagers.

There is also a need to provide shielding of a radio frequency antenna for environmental protection while minimizing the reflective or refractive transmission of radio frequency energy around the radio frequency shielding.

There is an additional need to provide or permit physical access to a radio frequency antenna without providing an escape path for radio frequency energy through shielding provided for the antenna.

There is a further need to minimize visibility and visual obviousness of a radio frequency antenna and its shielding.

SUMMARY OF INVENTION

The present invention involves placing a layer of radio frequency-energy-reflecting material between an antenna and people or objects near the antenna, that might be harmed by prolonged exposure to excessive amounts of radio frequency electromagnetic energy. A layer of radio frequency-energy-absorbing material is then placed between the reflecting material and the antenna, thereby absorbing a portion of the emitted energy that would otherwise pass to people or energy-sensitive objects near the antenna. The reflective layer then reflects energy that passes through the absorbing layer, further preventing the radio frequency energy from reaching people or energy-sensitive objects. The energy that is reflected by the reflective layer again passes through the absorbing layer, where another portion of the energy is absorbed. In this way, only a tiny portion of the original magnitude of transmitted energy finds its way back to the antenna and thus minimizes the amount of reflected back-scatter that might otherwise mix with and thus distort the transmission patterns of the signals issuing from the antenna.

In another aspect of the present invention, an absorbing layer is placed between the combination absorbing & reflective layers and a radio frequency-energy transmitting or transparent layer through which the radio frequency energy is intended to be transmitted.

BRIEF DESCRIPTION OF DRAWINGS

A more complete understanding of the present invention will be had from the following detailed description when considered in connection with the accompanying drawings, wherein the same reference numbers refer to the same or corresponding items shown throughout the several figures, in which:

FIG. 2 is a simplified, partial sectional view of the upper portion of a typical window and false ceiling and blind cove inside the window of the building depicted in FIG. 1, the section taken as shown by the arrows of the line 2-2 of FIG. 1;

FIG. 3 is a view of the same cross section as shown in FIG. 2 but with the original window treatment removed and the first portion of an embodiment of the present invention shown mounted on or attached to the interior surface of the window;

DETAILED DESCRIPTION

The following detailed description of preferred embodiments refers to the accompanying drawings which illustrate specific embodiments of the invention. Other embodiments having different structures and operations do not depart from the scope of the present invention.

Figure 1:
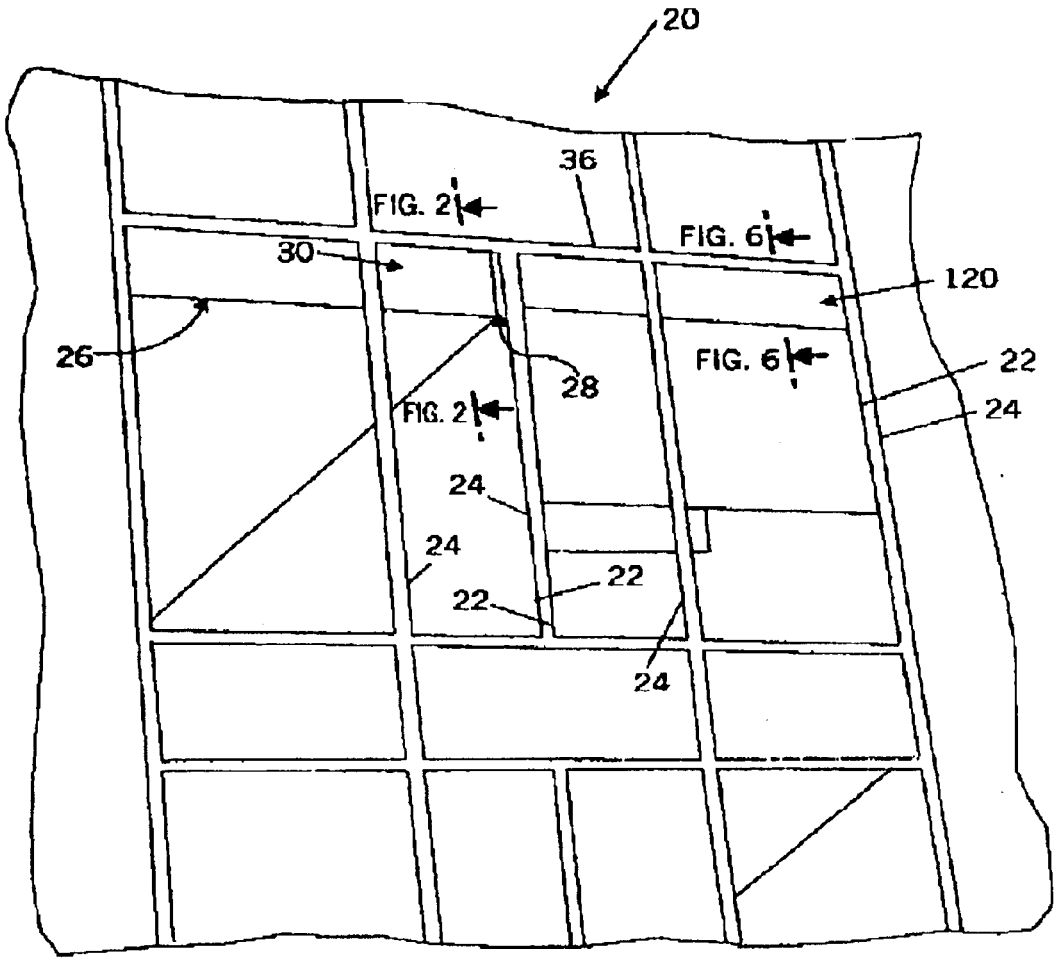
FIG. 1 is a perspective illustration of a portion of the windows of a building, showing a typical installation location of a shield in accordance with an embodiment of the present invention.

Referring now to the drawings and more particularly to FIG. 1, a typical window system of an urban office building is shown in a generalized elevational perspective view of a bay of windows 20. Four glass windows 22 are fully shown in FIG. 1. The four windows 22 are separated by three vertical, side mullions 24, which are usually metallic. The two leftmost windows 22 (as seen in FIG. 1) serve one partitioned space in the building and the two rightmost windows 22 serve another partitioned space. Each partitioned space has a false or dropped ceiling 26. As shown in the cross sectional view of FIG. 2, an open space or blind cove 28 is kept open between the end 30 of the false ceiling 26 and the window 22. The blind cove 28 provides space for full-length window coverings or treatments (not shown in FIG. 2), such as drapes, shades, or blinds. However, a top frame 32 for a blind is shown in FIG. 2, for illustration.

Referring now to FIG. 3, when a transmitting antenna is to be placed in the blind cove 28, in order to transmit radio frequency electromagnetic emissions through the window 22, the portion of the window treatment that occupies the blind cove 28 is removed. The glass of a typical window, being an electrically-insulating material, is almost transparent to radio frequency electromagnetic energy. Any metallic or other radio frequency-reflecting film should be removed from the window 22 in the area of the blind cove 28, where the radio frequency antenna is to be located, extending substantially from one vertical mullion 24 (FIG. 1) to another, across the width of the window or windows 22.

Radio frequency-energy-absorbing shielding material 34, for absorbing electromagnetic radio frequency energy, is first applied to the inside of the glass, near the top of the window 22, just beneath a horizontal, top mullion 36 of the window. More radio frequency-energy-absorbing material 38 is also applied to the inside of the glass of the window, approximately at the height of the bottom of the false ceiling 26. A second piece of radio frequency-energy-absorbing material 39 is placed over the radio frequency-energy-absorbing material 38 but does not extend down as far as the radio frequency-energy-absorbing material 38. Radio frequency-energy-absorbing material (not shown) is also arranged in a vertical direction and is attached to the glass in a location near the outer, side edges of the windows 22. The reason for and function of the energy-absorbing material attached to the inside of the window 22 will be explained below, in connection with FIG. 6.

The radio frequency-energy-absorbing material 34, 38, 39, and all of the other radio frequency-energy-absorbing material used and described in connection with the illustrative embodiment of the present invention may be a product of Cuming Corporation of Avon, Massachusetts, U.S.A. The Cuming radio frequency-energy-absorbing material is referred to by the manufacturer by the designation C-RAM MT-30 FR PSA, RF Absorber panel. It is available in 24×24 panels, preferably in thicknesses of ½ and ⅛. Both thicknesses are available with a pressure-sensitive adhesive backing, for easy application.

Figure 4:
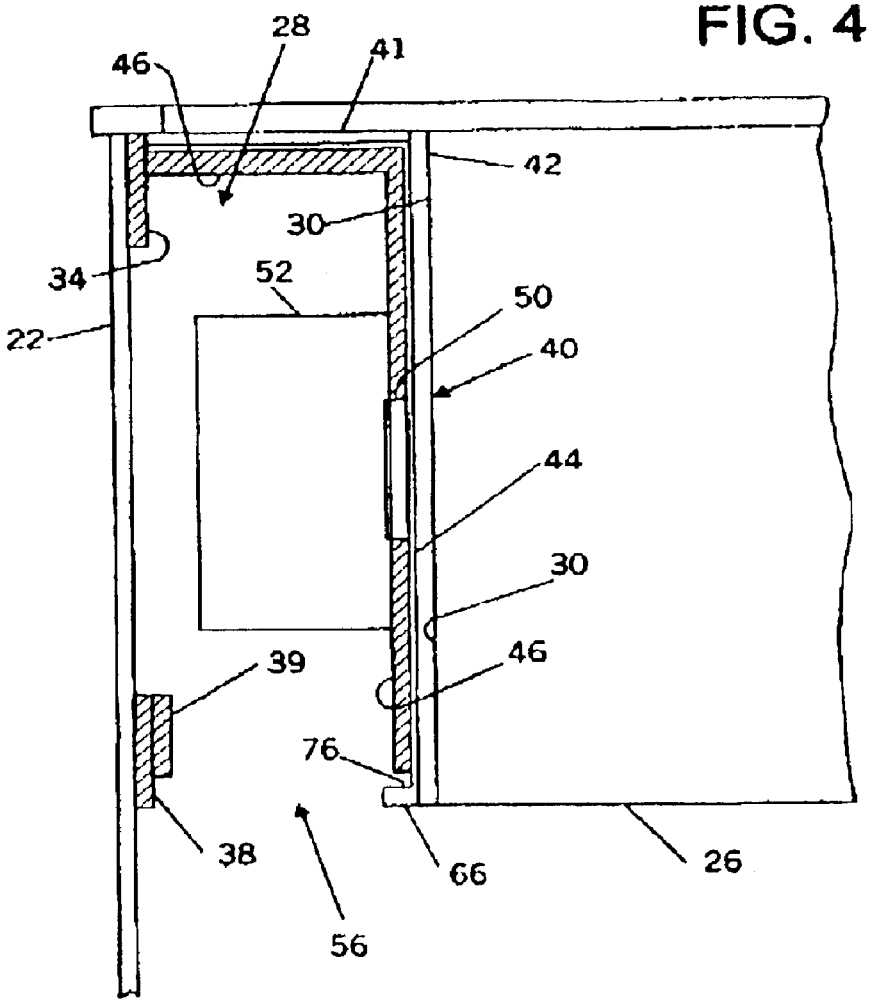
FIG. 4 is a view of the same cross section as shown in FIG. 3 but with a radio frequency antenna and shield in accordance with an embodiment of the present invention shown installed in the blind cove between the window and the false ceiling.

Referring now to FIG. 4, a major portion of a shield 40 is shown in place in the blind cove 28. For ease of construction, it is preferred that the shield 40 may be at least partially pre-fabricated and then placed in the blind cove 28, as shown in FIG. 4. However, for purposes of description, it is more understandable and more convenient to describe the shield 40 in situ, as shown in FIG. 4.

The outer, supporting structure of the shield 40 does not participate in the radio frequency-shielding process; therefore, any suitable construction material can be used. The supporting structure of the shield 40 is preferably made of duct board, wood, fiberglass, or gypsum board panels. The most prominent panels shown in FIG. 4 are a top panel 41 and a rear panel 42.

A radio frequency-reflecting layer 44 is placed on the inside of the panels 41 and 42, as well as other structural panels supporting the shield 40, which are not shown in FIG. 4. Radio frequency-reflecting layer 44 may be electrically-conductive material, such as metal foil that reflects radio frequency energy and is used to line the inside surfaces of all of the structural panels of the shield 40. The radio frequency-reflecting layer 44 or metal foil may be aluminum foil. For example, extra heavy duty Reynolds Wrap™ aluminum foil can be used, however, aluminum foil with an adhesive back might be easier to mount to the inside of the panels. If metal foil-covered board such as R-Matte™ manufactured by Rmax, Inc. located in Dallas, Tex., U.S.A., is used as the structural material of the panels, the reflective foil covering the panel material should be sufficient.

Radio frequency-energy-absorbing material 46, preferably about ½ thick, covers the radio frequency-reflecting aluminum foil 44, that lines the inside of the portion of the shield structure comprised of the aluminum-lined panels 41 and 42 that are shown in FIG. 4. The insides of all of the other aluminum foil-lined panels (not shown in FIG. 4) of the structure of the shield 40 are also similarly lined with radio frequency-energy-absorbing material. A gap is formed in the radio frequency-energy-absorbing material 46 that is mounted on the rear panel 42. That gap is filled with an antenna-mounting board 50.

The antenna-mounting board 50 is nominally a 1×4 piece of lumber fully covered with a conductive material or aluminum foil. Holes are drilled through the antenna-mounting board 50 to accommodate bolts (not shown) for mounting an antenna 52 to the board 50 and supported by the rear panel 42, that is in contact with the end 30 of the false ceiling 26. The bolts mount the antenna 52 to the board 50 and to the rear panel 42. The aluminum foil that is wrapped around the board 50 is thus held in intimate electrical contact with both the antenna 52 and the aluminum foil 44 that is between the rear panel 42 and the radio frequency-energy-absorbing material 46.

Figure 5:
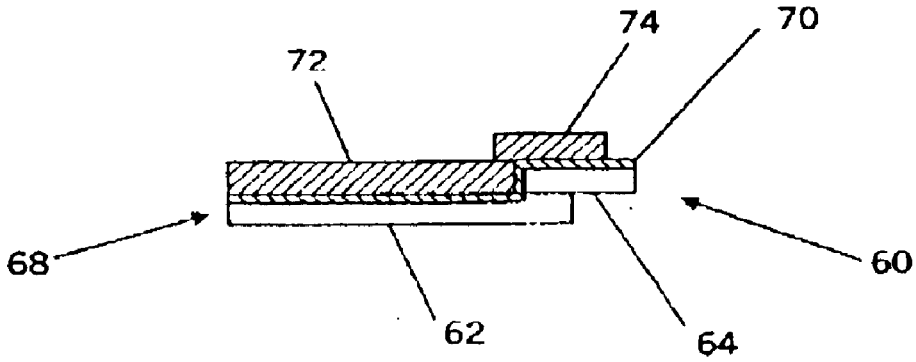
FIG. 5 is a detailed sectional view of an access door of a shield in accordance with an embodiment of the present invention, showing some of the details of the door's construction.

An opening 56 may exist at the bottom (in FIG. 4) of the shield 40. This opening is for access to the antenna 52, inside of the shield 40. Referring now to FIG. 5, a cross section of a door 60 is shown, for closing that bottom opening 56 of the opening 56 in the shield 40. This door 60 extends the full width of the shield 40, along the width of the window 22. The door 60 is preferably made of two pieces of structural panel material. One panel-material piece 62 is the main structure of the door 60. A second panel-material piece 64 is a step 64 that is firmly attached along one edge of the panel-material piece 62. When in place and closing the opening at the bottom (FIG. 4) of the shield, the door 60 is held in place by the step 64 resting on top of a lip 66 (FIG. 4) of panel material. A left end 68 of the door 60 is then preferably held in place by clips or locks 102, 104, 106 and 108 shown in FIGS. 9 and 10 and described below.

Returning again to FIG. 5, a piece of aluminum foil 70 covers the top of the panel pieces 62 and 64 of the door 60 and is so constructed as to make electrical contact with the aluminum foil 44 that covers the rear panel 42 of the shield 40. Radio frequency-energy-absorbing material 72 covers the aluminum foil 70 on top of the panel-material piece 62. More radio frequency-energy-absorbing material 74 covers the aluminum foil 70 over the panel-material step piece 64, overlapping the radio frequency-energy-absorbing material 72, to prevent any gaps. The step piece 64 fits tightly into a gap 76 (FIG. 4) between the radio frequency-energy-absorbing material 46 on the rear panel 42 of the shield and the lip 66 of panel material. The radio frequency-energy-absorbing material 74 is not as long as the panel-material step piece 64 and abuts the radio frequency-energy-absorbing material 46.

Figure 6:
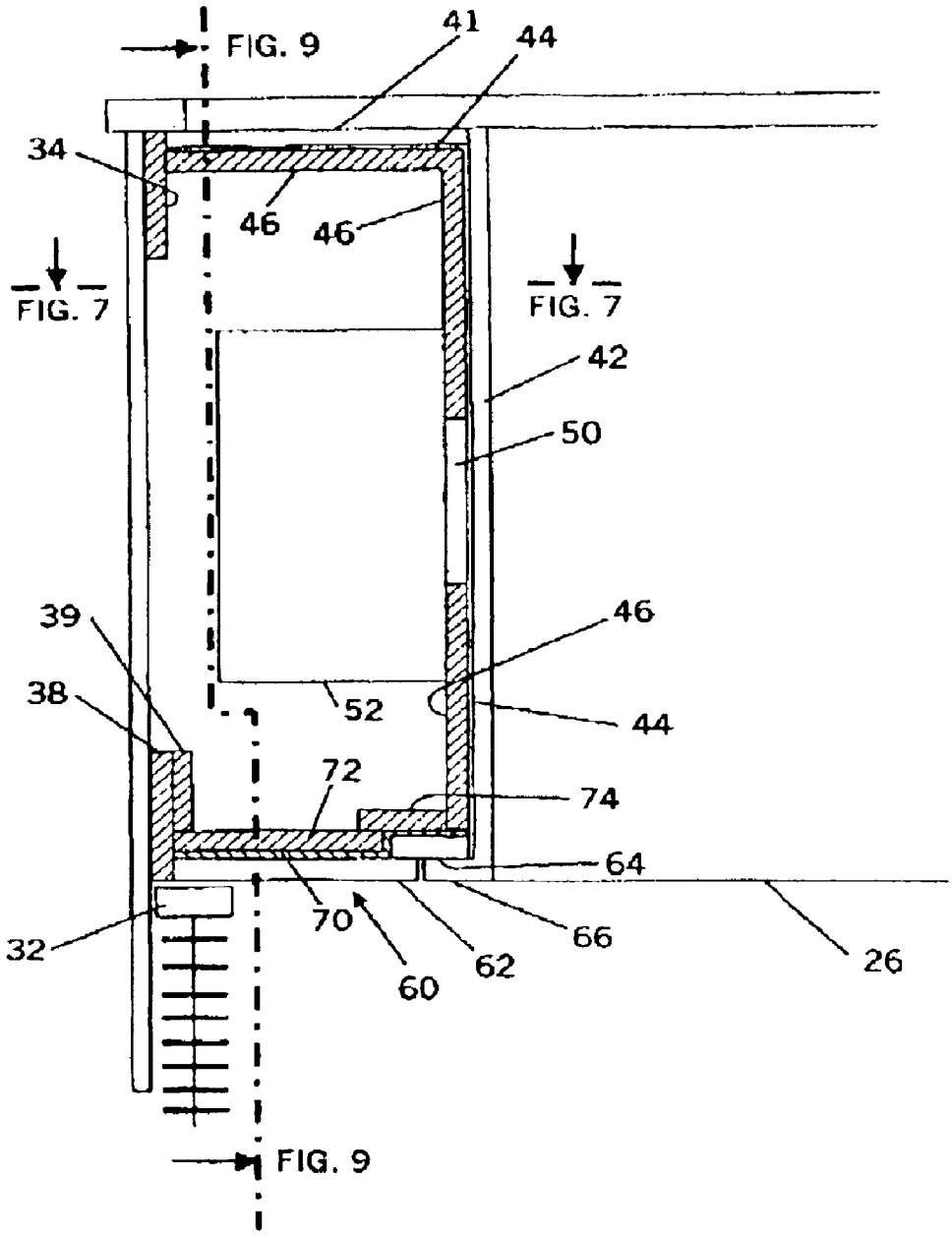
FIG. 6 is a sectional view, of the same section shown in FIG. 4 but with an access door in place and a substitute window treatment shown below the shield in accordance with an embodiment of the present invention, the section taken as shown by the arrows of the line 6-6 of FIG. 1.

Referring now to FIG. 6, the sectional view of FIG. 1 is shown with the door 60 of FIG. 5 shown in place. In this view (FIG. 6), it will be noted that the radio frequency-energy-absorbing material 72, of the door 60, abuts the radio frequency-energy-absorbing material 38 and underlies the bottom of the radio frequency-energy-absorbing material 39. The step 64 of the door 60 rests on the lip 66, and the radio frequency-energy-absorbing material 74 abuts the radio frequency-energy-absorbing material 46 on the rear panel 42.

The top frame 32 of the window treatment is then reinstalled, shown in FIG. 6 with a blind hanging from it. However, the window treatment should not be positioned so close to the door 60 that the top frame 32 prevents the door 60 from opening, unless it is intended that the window treatment, and its top frame 32 be removed any time that the door 60 is to be opened.

Figure 7:
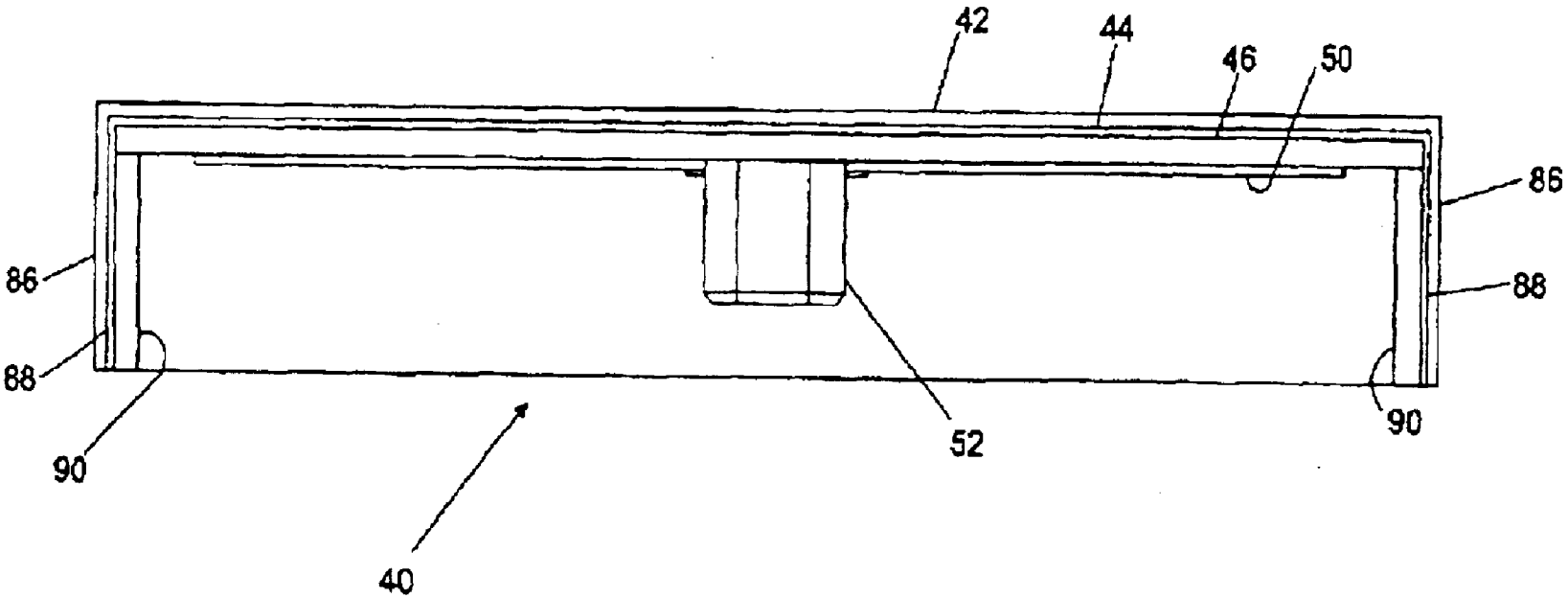
FIG. 7 is a partial sectional illustration of a top view of the shield in accordance with an embodiment of the present invention, taken in the direction of the arrows 7-7 of FIG. 6.

FIG. 7 is a cross-section view from the top of the shield 40, taken in the direction of lines 7-7 of FIG. 6. The rear panel 42 supports the aluminum foil 44 and the radio frequency-energy-absorbing material 46, along with the mounting board 50 and the antenna 52. In addition, structural side panels 86 are shown, lined with aluminum foil 88 and with radio frequency-energy-absorbing material 90 over the aluminum foil.

Figure 8:
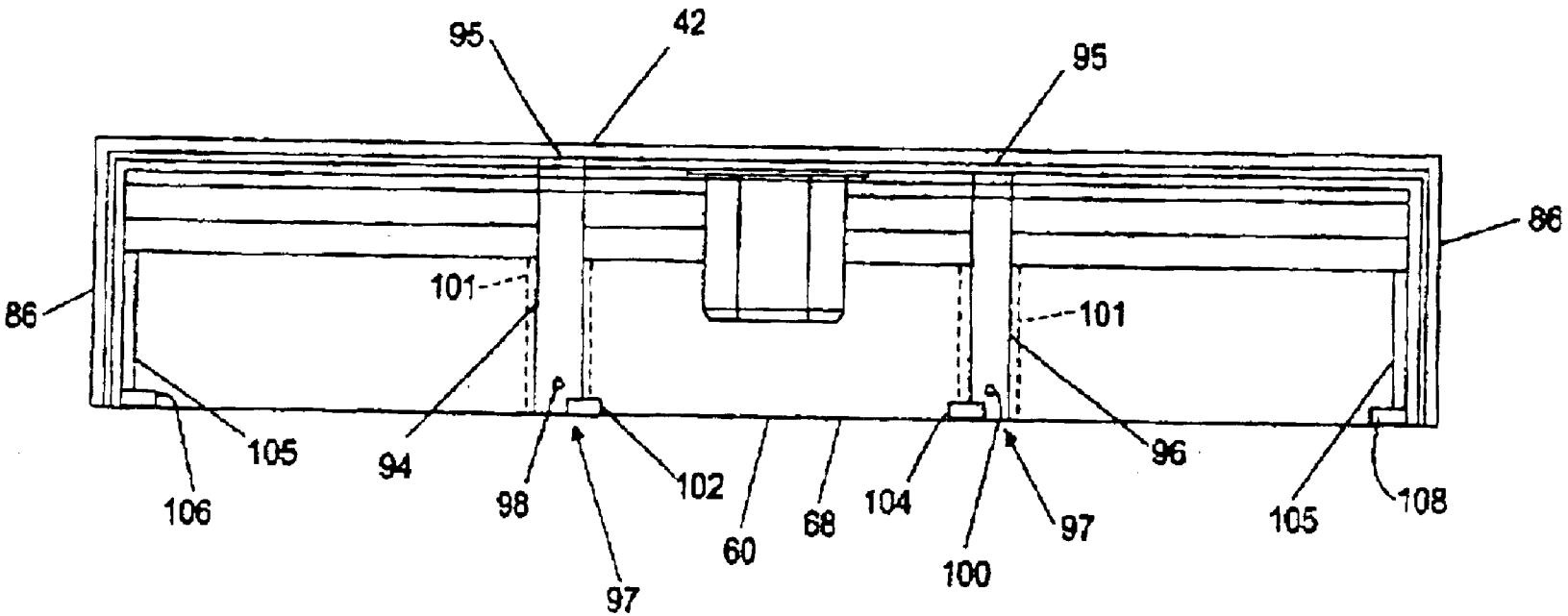
FIG. 8 is a more detailed partial sectional illustration, as in FIG. 7, showing more of the details of construction and support of the shield in accordance with an embodiment of the present invention.

Referring now to FIG. 8, there is shown a sectional view from the same direction as FIG. 7. However, additional parts of the structural support of the door 60 are shown. Two support arms 94 and 96, each having an inner end 95 and an outer end 97, are attached, for support, at their inner ends 95, to the bottom of the rear panel 42. The support arms 94 and 96 project into the opening 56 of the shield. These two support arms are also suspended from the top panel 41 (FIG. 4) by two dowels 98 and 100, which are attached near the outer ends 97 of the support arms 94 and 96. These two dowels are of an electrically-non-conducting material, preferably such as wood or fiberglass, so as to be substantially transparent to radio frequency energy and are shown and described more fully in connection with FIGS. 9 and 10.

The support arms 94 and 96 are engaged by rotating locks 102 and 104. Two more rotating locks 106 and 108 engage lips 105 on the side panels 86. The four rotating locks 102, 104, 106, and 108 are mounted proximate to the left end 68 of the door 60 and hold the door in place, as shown more clearly in FIGS. 9 and 10. The four rotating locks can be better understood by the description (below) in connection with those latter two figures. The four rotating locks can be of a type rotatable by a screwdriver or wrench or can even be equipped with an internal key lock, in order to discourage unauthorized exploration of the antenna.

Figure 9:
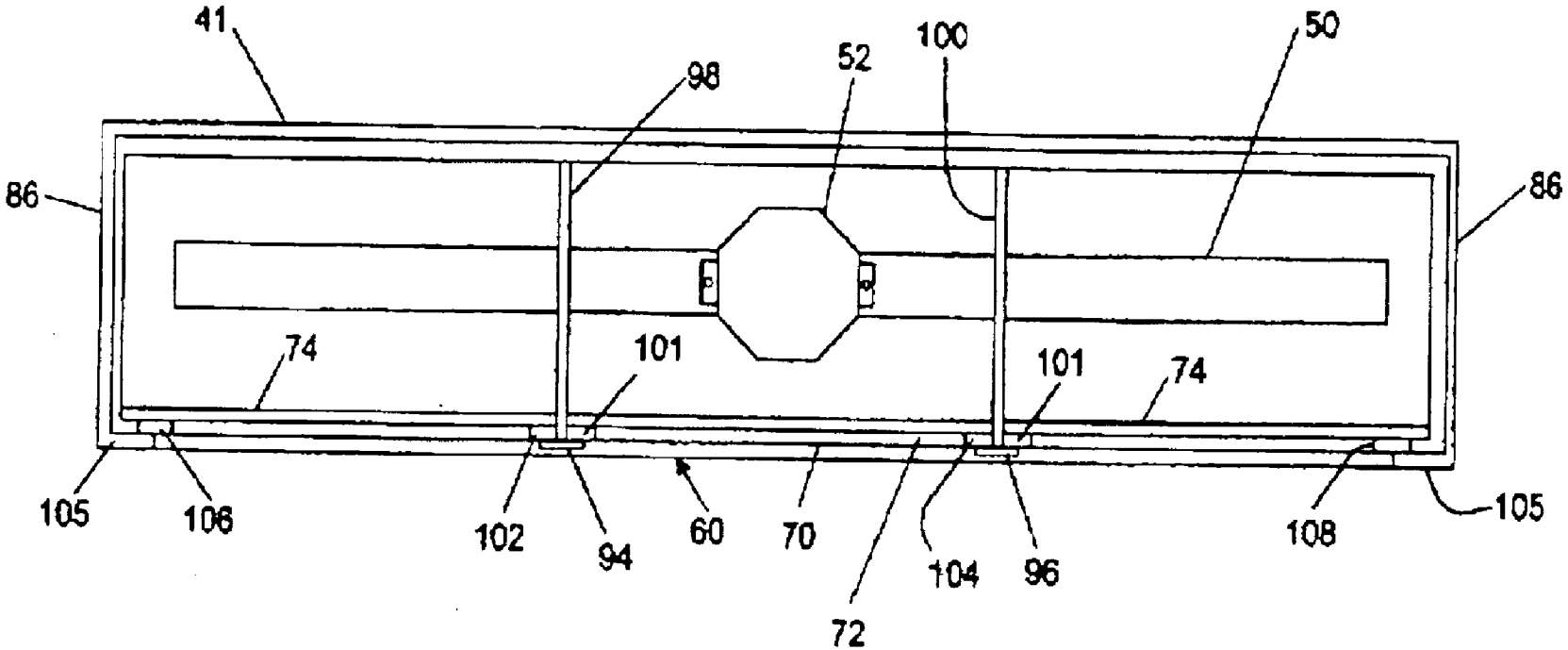
FIG. 9 is an elevational, front view of the shield in accordance with an embodiment of the present invention, taken in the direction of the arrows 9-9 of FIG. 6.

FIG. 9 is a front view of the shield 40 as it would be presented to the windows 22. The dowels 98 and 100 are shown suspending the support arms 94 and 96 to prevent the weight of the door 60 from putting excessive bending stress on the attachment of the support arms 94 and 96 to the rear panel 42 (FIG. 8). The four rotating locks 102, 104, 106, and 108 are also illustrated in their positions engaging the support arms 94 and 96 and the lips 105.

Figure 10:
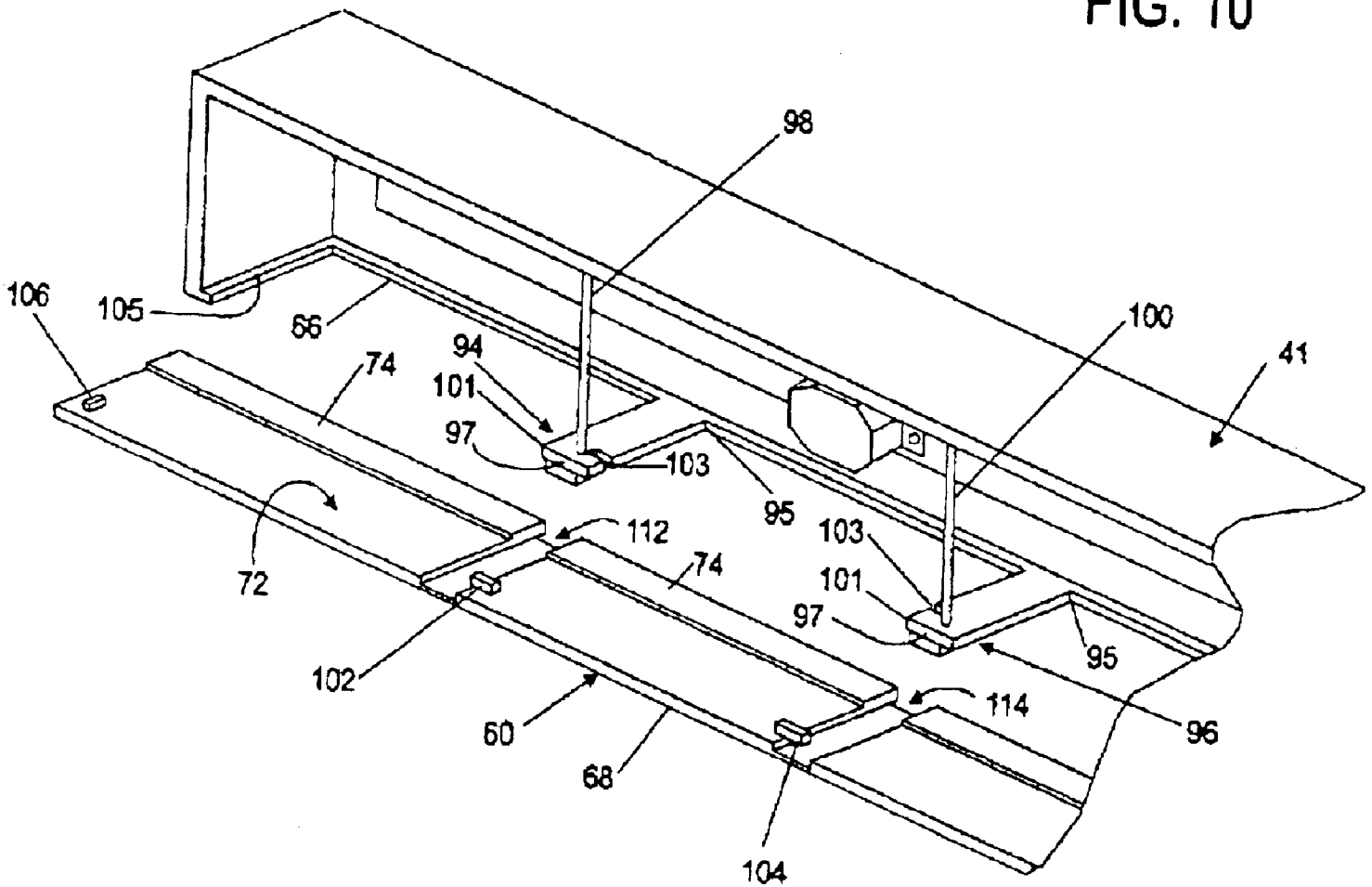
FIG. 10 is an elevational front view of the shield in accordance with an embodiment of the present invention, taken in the same general direction as in FIG. 9 but shown in perspective and with the door.

The partial perspective view of FIG. 10 shows, in greater detail, the cooperation between the door 60 and the support arms 94 and 96. There are gaps 112 and 114 in the radio frequency energy-absorbing material 72 and 74 to accommodate the support arms 94 and 96. The support arms 94 and 96 are topped with layers 101 of aluminum foil and radio frequency-energy-absorbing material to cover and thus compensate for the gaps 112 and 114 in the door 60. The rotating lock 106 is shown in its unlocked position, and the rotating locks 102 and 104 are arbitrarily illustrated in their locked positions. The layers 101 of foil and radio frequency-energy-absorbing material may be cut or notched 103 to accommodate the rotating locks 102 and 104.

The inside of the windows 22 that cover the antenna 52 and the shield 40 are preferably covered with an electrically non-conducting opaque or translucent film 120 (FIG. 1). The purpose of the opaque or translucent film is to avoid disrupting the esthetic appearance of the building or calling the attention of passers-by to the presence of a radio frequency antenna. The antenna is high enough and directional enough to keep excessive radio frequency radiation away from passers-by at sidewalk level. The principle purpose of the shield 40 is to protect occupants of the building whose work locations are proximate the antenna.

Theory of Operation

When the antenna 52 is emitting radio frequency energy, the preferred direction of emission is directly out through the windows 22.

To that end, any radio frequency electromagnetic emissions that do not go out through the windows 22 will pass through the radio frequency-energy-absorbing material on the inside of the shield and suffer substantial attenuation. Any radio frequency electromagnetic energy that passes through the radio frequency-energy-absorbing material on the inside of the shield reflects off of the aluminum foil, back through the radio frequency-energy-absorbing material, in the opposite direction. That reflected radio frequency electromagnetic energy is further attenuated by the radio frequency-energy-absorbing material on its return journey. That twice-attenuated radio frequency electromagnetic energy then has a low enough energy level to be harmless as it re-enters the inside of the shield 40. That low energy level is inadequate to disrupt the desired radio frequency emissions and certainly inadequate to be injurious if a minute amount of it should exit through the windows 22.

As radio frequency electromagnetic energy passes through the glass of the windows 22, a slight amount is reflected back into the interior of the shield 40. Any such radio frequency energy that is reflected directly back to the antenna 52 has an effect on the antenna standing wave ratio and the efficiency of propagation through the glass, but does not effect the shielding. However, a percentage of the antenna emissions does not strike the glass at a right angle to the surface of the glass. This is the purpose of the radio frequency-energy-absorbing material 34, 38, and 39 that is located against the windows 22 (see FIGS. 3, 4, and 6). Also, additional radio frequency-energy-absorbing material (not shown) is attached to the windows 22 in the regions of the side panels 86.

Radio frequency electromagnetic emissions that strike the glass windows at an oblique or acute angle to the surface of the glass reflect away from the glass and are absorbed by the radio frequency-energy-absorbing material that lines the interior of the shield 40. However, some of that energy is also refracted as it enters the glass and reflects off of the outside surface of the glass, back into the interior of the glass. That radio frequency energy that obliquely reflects and refracts within the pane of the glass window can travel inside of the pane of the glass until it passes through the interior surface of the glass beyond the control of the shield 40. That escaping radio frequency energy might, over the course of a working year, provide an undesirable amount of exposure to any person whose work location is proximate the windows 22.

In order to protect any person who might spend a working career near a radio frequency antenna, the radio frequency-energy-absorbing material 34, 38, and 39 and additional radio frequency-energy-absorbing material (not shown) to which the side panels 86 abut—has been placed directly in contact with the inside surface of the windows 22. This absorbing material that is attached directly to the inside surface of the window has a substantial length of its contact with the window, along the path that the energy would have to take as it refracts and reflects within the body of the glass window. That part of the absorbing material that extends along the window in a direction generally toward the antenna maximizes the angle at which the radio frequency energy strikes the interior surface of the glass. Therefore, the obliqueness of the angle at which the energy strikes the glass is minimized. Minimizing obliqueness of the angle of incidence of the energy as it strikes the glass also minimizes the refraction of the energy within the glass. Minimizing the obliqueness of the angle of incidence and the resulting refraction also minimizes the obliqueness of the angle of reflection of the energy as it exits the glass at the exterior surface of the glass.

A percentage of the energy that reflectively travels within the body of the glass exits through the interior and exterior surfaces of the glass at each reflection. By extending the radio frequency-energy-absorbing material, e.g. 34, 38, and 39, along the interior surface of the glass, transmission of that energy traveling within the glass through the interior surface of the glass and into the interior of the building proximate the glass is minimized.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A shield for shielding radio frequency electromagnetic emissions, originating from a source of such emissions, comprising:

a layer of absorbent material having the physical property of generally absorbing electromagnetic radio frequency emissions;

a layer of reflecting material having the physical property of generally reflecting electromagnetic radio frequency emissions;

the layer of absorbent material being positioned between the layer of reflecting material and a source of radio frequency electromagnetic emissions, so that the radio frequency electromagnetic emissions pass through the layer of absorbent material, with a portion of the radio frequency electromagnetic emissions being thus absorbed within the layer of absorbent material, the remainder of the radio frequency electromagnetic emissions being reflected by the layer of reflecting material back through the layer of absorbent material, which in turn absorbs a further portion of the remaining emissions;

the energy-absorbing capability of the layer of absorbent material being so selected as to be calculated to absorb, in two passes of the radio frequency electromagnetic emissions through the first layer of material, enough radio frequency energy to reduce the magnitude of the radio frequency electromagnetic emissions to an arbitrarily-desired low magnitude; and a support structure for supporting the layer of absorbent material and the layer of reflecting material, to form a container for a transmitting structure for radio frequency electromagnetic emissions, with at least one opening in said container effectively open for escape of the radio frequency electromagnetic emissions in at least one arbitrary, desired direction for propagation of the radio frequency electromagnetic emissions.

2. A shield for shielding electromagnetic radio frequency emissions, according to claim 1, wherein: the radio frequency electromagnetic emissions to be shielded are emitted by a communications antenna mounted within said container.

3. A shield for shielding radio frequency electromagnetic emissions, according to claim 1, wherein: the layer of reflecting material having the physical property of generally reflecting radio frequency electromagnetic emissions is comprised of any substantially-electrically-conductive material.

4. A shield for shielding radio frequency electromagnetic emissions, according to claim 3, wherein: the layer of reflecting material having the physical property of generally reflecting radio frequency electromagnetic emissions is comprised of a metal foil.

5. A shield for shielding radio frequency electromagnetic emissions, according to claim 4, wherein: the metal foil, of which the layer of reflecting material is comprised so as to have the physical property of generally reflecting radio frequency electromagnetic emissions, is comprised of aluminum foil.

6. A shield for shielding radio frequency electromagnetic emissions, according to claim 1, wherein: the layer of absorbent material and the layer of reflecting material are so positioned as to constitute the interior lining of a generally-rectangular box having sides, with a communications antenna, comprising said source of radio frequency electromagnetic emission, mounted on the interior surface of one of said sides.

7. A shield for shielding radio frequency electromagnetic emissions, according to claim 1, wherein said supporting structure is open at an opening for physical access to said source.

8. A shield for shielding radio frequency electromagnetic emissions, according to claim 7, further including a door for closing said opening, said door also including a layer of reflecting material and a layer of absorbent material located on the side of the door nearest to the source.

9. A shield for shielding radio frequency electromagnetic emissions, according to claim 8, further including at least one support arm, having an inner end and an outer end and extending from said support structure, with its inner end attached to said support structure, for supporting said door.

10. A shield for shielding radio frequency electromagnetic emissions, according to claim 9, further including at least one electrically non-conducting dowel for supporting said outer end of said at least one support arm.

11. A shield for shielding radio frequency electromagnetic emissions, according to claim 10, further including a plurality of locking members for locking said door to said supporting structure.

12. A shield for shielding radio frequency electromagnetic emissions from a source of such emissions, comprising:

a layer of absorbent material having the physical property of generally absorbing radio frequency electromagnetic emissions;

a layer of reflecting material having the physical property of generally reflecting radio frequency electromagnetic emissions;

the layer of absorbent material being positioned between the layer of reflecting material and a source of radio frequency electromagnetic emissions, and a framework, comprising a container, for supporting said source of radio frequency electromagnetic emissions, the layer of absorbent material and the layer of reflecting material, said framework having at least one opening therein for relatively free passage of radio frequency electromagnetic emissions in a direction determined by the relative positions of said source of radio frequency electromagnetic emissions and said opening.

13. A shield for shielding radio frequency electromagnetic emissions, according to claim 12, wherein: said at least one opening in the container is positioned in close proximity to an electrical insulating material that is capable of protecting the source of radio frequency electromagnetic emissions from weather and other physical elements but which is substantially transparent to radio frequency electromagnetic emissions.

14. A shield according to claim 13 wherein said electrical insulating material is glass.

15. A shield according to claim 14 wherein said glass is a window of a building, said source of radio frequency electromagnetic emissions being so positioned in the window and the window being so located within the building that the radio frequency electromagnetic emissions are directed predominantly over the heads of pedestrians walking or driving past the building.

16. A shield according to claim 13 further comprising at least one strip of said layer of absorbent material located between said electrical insulating material and said container for attenuating emissions that reflect within the electrical insulating material and refract upon entering and leaving said electrical insulating material, for absorbing emissions which reflect from the surfaces of said insulating material, so as to attenuate emissions reflecting at the surfaces of the electrical insulating material, which would thus escape from the container into regions where long-term exposure to such emissions might cause harm.

17. A shield according to claim 13 further comprising at least one strip of absorbent material separating the sides of said container from the insulating material, said strip being elongated along the insulating material so as to present substantially more surface area of absorbent material in contact with the insulating material than would an extension of the absorbent material which is supported directly by the sides of the container.

18. A shield according to claim 17 wherein said at least one strip of absorbent material extends part-way into said opening, so as to restrict obliqueness at which said radio frequency electromagnetic emissions exit said opening from said source.

19. A shield according to claim 12 further comprising: an access opening in said container for ready access to the interior of said container; and a cover for said access opening, said cover being constructed with the same absorbent and reflecting layers as the remainder of the container, for normally closing said opening and constructed to provide the same level of shielding as the other shielding sides of the container.

20. A method of attenuating the transmission of radio frequency electromagnetic energy within a sheet of material that is substantially transparent to the passage of radio frequency electromagnetic energy emissions, said sheet have two substantially parallel surfaces, which comprise the limits of the interior of the sheet, and having a thickness through which the radio frequency electromagnetic energy emission is transmitted, said method comprising placing an radio frequency electromagnetic energy absorbing material along at least one surface of said sheet of material to absorb radio frequency electromagnetic energy that diffracts at the surfaces of the sheet as the radio frequency electromagnetic energy enters and leaves the transparent material and reflects from the interiors of the surfaces of the transparent material, so as to propagate by interior reflections through the transparent material in a direction substantially but not exactly parallel to the surfaces of said material.

21. A method according to claim 20 wherein said placing step comprises positioning said radio frequency electromagnetic energy absorbing material between the sheet and the perimeter of an opening in a shielded container for a source of radio frequency electromagnetic emission.

22. A method according to claim 21 wherein said radio frequency electromagnetic energy absorbing material is made sufficiently wide and so positioned in said placing step so as partially to obstruct the perimeter of said opening.

* * * * *